US005846112A

United States Patent [19]

Baker

[11] Patent Number: 5,846,112

[45] Date of Patent: Dec. 8, 1998

[54] FLIGHT CONTROL MECHANISM FOR MODEL AIRPLANES

[76] Inventor: Leo J. Baker, 505 Giles, St. Johns, Mich. 48879

[21] Appl. No.: 618,203

[22] Filed: Mar. 19, 1996

[51] Int. Cl.[6] ..... A63H 27/00; A63H 27/14

[52] U.S. Cl. ..... 446/68; 446/64

[58] Field of Search ..... 446/68, 67, 66, 446/64, 13, 61, 36

[56] References Cited

U.S. PATENT DOCUMENTS

| | | | |
|---|---|---|---|
| 927,815 | 7/1909 | Ruppin | 446/68 X |
| 1,400,097 | 12/1921 | Perkins . | |
| 1,723,618 | 8/1929 | Hodgson | 446/68 |
| 2,513,688 | 7/1950 | Strong | 446/66 |
| 2,588,941 | 3/1952 | Stark . | |
| 2,599,957 | 6/1952 | Walker . | |
| 2,820,322 | 1/1958 | White . | |
| 2,850,838 | 9/1958 | Henneberry . | |
| 3,084,477 | 4/1963 | Whatley . | |
| 3,113,398 | 12/1963 | Merritt | 446/66 X |
| 3,157,960 | 11/1964 | Schultz et al. . | |
| 3,181,269 | 5/1965 | Nixon | 446/68 |
| 3,839,818 | 10/1974 | Heggedal | 446/68 X |
| 3,995,393 | 12/1976 | Patterson | 446/66 |
| 4,282,675 | 8/1981 | Stripling, Jr. | 446/64 |
| 4,466,213 | 8/1984 | Alberico et al. . | |
| 4,863,412 | 9/1989 | Mihalinec . | |
| 4,863,413 | 9/1989 | Schwarz . | |
| 4,915,664 | 4/1990 | Bakker | 446/66 X |

FOREIGN PATENT DOCUMENTS

| | | | |
|---|---|---|---|
| 553683 | 6/1932 | Germany | 446/68 |

*Primary Examiner*—Robert A. Hafer
*Assistant Examiner*—D. Neal Muir
*Attorney, Agent, or Firm*—Mary M. Moyne; Ian C. McLeod

[57] ABSTRACT

A flight control apparatus (10, 210, 310 or 410) for use in a model airplane (50, 250, 350 or 450) is described. The apparatus includes a weight (20, 220, 320 or 420) and a resilient band (24, 224, 324 or 424). In the first three embodiments, the weight is mounted in a housing (12, 212 or 312) with the resilient band connected between the weight and the housing. In the fourth embodiment, the weight is mounted on the fuselage (452) of the airplane. The airplane is launched using a standard slingshot-like launching device (56). The resilient member (56A) is mounted around the extension (22, 222 or 422) of the weight in the first, second and fourth embodiments. In the third embodiment, the resilient member is mounted around a hook (354) on the head (350A) of the airplane. To launch, the user (100) holds the tail (60) of the airplane and pulls forward on the post (56B) of the launching device which pulls the weight of the apparatus to the forward most position. The user releases the tail of the airplane and the airplane is launched into the air. Once the airplane reaches its maximum acceleration and begins to decrease in speed, the force of inertia of the weight decreases. When the force of inertia tending to hold the weight forward becomes less than the force of the resilient band, the weight is moved backward.

33 Claims, 10 Drawing Sheets

FLIGHT CONTROL MECHANISM FOR MODEL AIRPLANES

BACKGROUND OF THE INVENTION (1) Field of the Invention

The present invention relates to a flight control apparatus for use in model airplanes. In particular, the present invention relates to a flight control apparatus for use in model airplanes where a weight of the apparatus moves during flight of the airplane to control the flight of the airplane. The weight of the apparatus moves when the force of the resilient band in one direction is greater than the force of inertia acting on the weight tending to move the weight in the other direction.

(2) Description of the Related Art

The related art has shown various model airplanes having flight control apparatus. Illustrative are U.S. Pat. Nos. 1,400,097 to Perkins; 2,588,941 to Stark; 2,820,322 to White; 2,850,838 to Henneberry; 3,084,477 to Whatley; 3,157,960 to Schultz et al and 4,466,213 to Alberico et al. Of particular interest are U.S. Pat. Nos. 2,599,957 to Walker; 4,863,413 to Schwarz; 4,863,412 to Mihalinec and 4,915,664 to Bakker.

U.S. Pat. No. 2,599,957 to Walker describes a toy airplane having a movable weight. Initially, the weight is forward of the airplane's center of lift but as the airplane approaches its point of maximum altitude, the weight moves to a proper balancing position to give the airplane a good gliding angle. The weight is mounted on a wire having a helical thread located in an elongated slot in the fuselage extending from the nose to beneath the wings. The weight is preferably cylindrical and has a series of airstream-engaging tunnels which extend longitudinally and which are helically disposed with respect to the longitudinal axis of the weight. The wire extends through an axial, non-circular hole in the weight which allows the weight to rotate as the weight is shifted longitudinally. After launch, the inertia of the weight causes the weight to rotate as the forward velocity and the relative velocity of the airstream decreases. Consequently, the weight is moved to its rearward position as the airplane loses its forward momentum and as it reaches its point of greatest altitude. The weight shifts rearward until the airplane assumes a good gliding angle for its downward glide. The airstream engaging tunnels of the weight can also be in the form of laterally extending fins.

U.S. Pat. No. 4,863,413 to Schwarz describes a bird-shaped toy glider which has a collapsible wing structure. A pivot pin extends through a hole in the body behind the wings and serves to maintain the wings in a level position during flight. A rubber band contacts the pin to maintain the wing structure in proper flight position during flight. The pin also assists in guiding the rubber band in its movement from when the wings are collapsed for launching to when the wings are released for glider flight. The rubber band functions as a resilient spring-like means for securing the collapsible wing structure on the body in a direction rearward of the center of gravity of the glider. The rubber band co-acts with the wings enabling them to be released from their glider launch position into the free flight position when air pressure on the glider has diminished sufficiently so that the rubber band can pull the wings back into the free flight position.

U.S. Pat. No. 4,863,412 to Mihalinec shows a glider toy having pivotable wings which are pulled into flight orientation by an elastic band when the glider reaches its ultimate height. The glider is launched using a slingshot-like catapult.

U.S. Pat. No. 4,915,664 to Bakker describes a toy glider which has collapsible wings and which is launched using a slingshot-like launcher. The launcher is attached to a launch hook which, when pulled forward, rotates the wings back into a converged position. A rubber band is attached from the leading edge of the wings to a position forward of the wings and tends to urge the wings into the extended position. The wings remain converged as long as the forces (air pressure) tending to rotate the wings rearward are greater than the biasing force tending to rotate the wings into an extended position.

There remains the need for a flight control apparatus for use in a model airplane which uses the change in the inertia of a weight of the apparatus to move the weight to vary the flight pattern of the airplane where the apparatus is simple and inexpensive to manufacture.

OBJECTS

It is therefore an object of the present invention to provide a flight control apparatus for use in a model airplane which uses a weight moved by a resilient band to change the flight pattern of the airplane when the inertial force of the weight drops below a preset minimum due to the deceleration of the airplane. Further, it is an object of the present invention to provide a flight control apparatus for use in a model airplane where the initial position of the weight which controls the flight pattern is set by the user during launch. Still further, it is an object of the present invention to provide a flight control apparatus for use in a model airplane which extends the flight time of the airplane. Further still, it is an object of the present invention to provide a flight control apparatus for use in a model airplane which is easy to manufacture. Further, it is an object of the present invention to provide an improved model airplane having a flight control apparatus which uses a resilient member to shift a weight in the fuselage of the airplane to change the flight pattern of the airplane.

These and other objects will become increasingly apparent by reference to the following drawings and the description.

DETAILED DESCRIPTION OF THE PREFERRED EMBODIMENT

Figure 1:
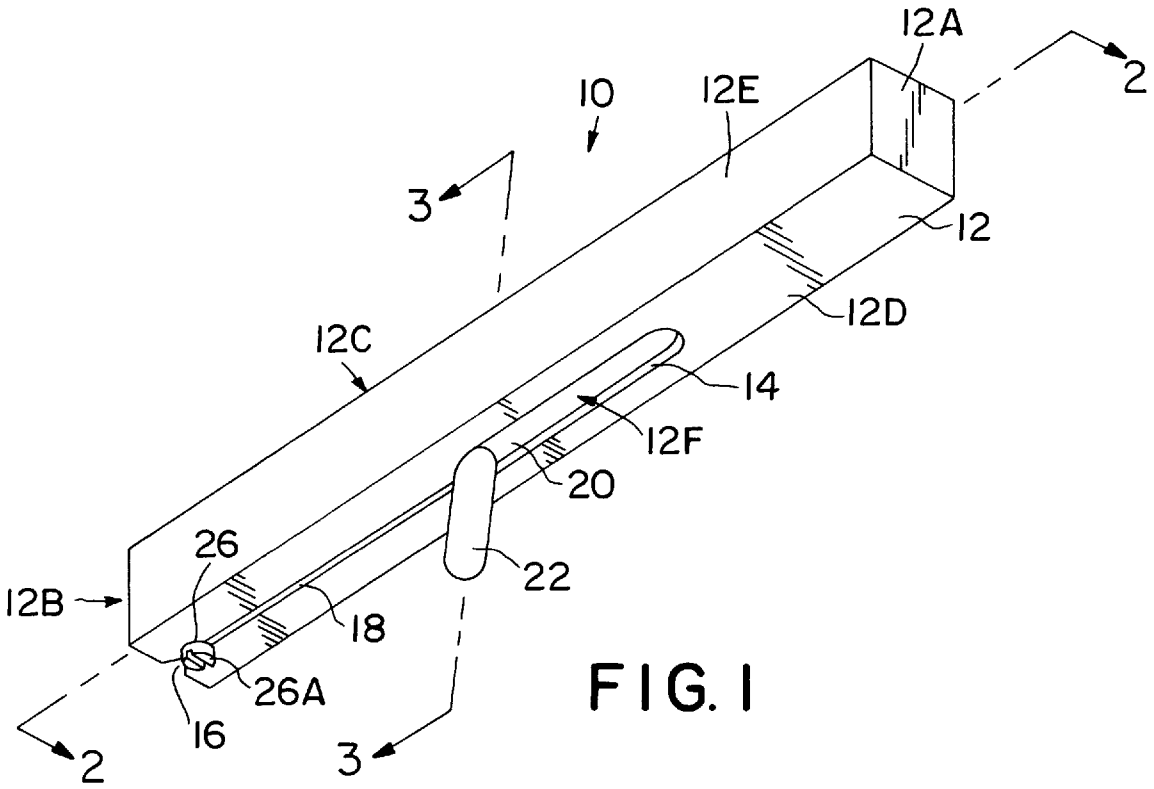
FIG. 1 is a perspective view of the flight control apparatus 10.

The present invention relates to a flight control apparatus for use in controlling a flight pattern of a toy airplane having a nose and a tail during launch and flight, which comprises: a support means having opposed ends which defines a path between the nose and the tail of the airplane with an opening between the ends along the path; a weight slidably mounted on the support means for movement along the path and with an extension provided on the weight which extends through the opening of the support means; and a resilient means mounted on the weight and adjacent the weight which acts to move the weight to control the flight pattern of the airplane when the airplane reaches a point in the flight during the launch when a force of the resilient means tending to move the weight in the path towards the tail in a direction opposite a direction of the flight of the airplane is greater than a force of inertia of the weight tending to prevent the weight from moving in the direction towards the tail in the path after the launch and during the flight.

Further, the present invention relates to a flight control apparatus for use in controlling a flight pattern of a toy airplane having a nose and a tail during launch and flight, which comprises: a housing having opposed ends with a top wall, a bottom wall and a sidewall extending therebetween and forming a channel defining a path between the ends, the bottom wall having an opening along the path between the ends which extends into the channel; a weight slidably mounted in the channel of the housing adjacent the bottom wall provided with an extension for moving the weight in the path which extends through the opening in the bottom wall of the housing; and a resilient means mounted in the channel of the housing between the housing and the weight providing a bias towards the tail of the airplane, wherein prior to and during launch of the airplane, the weight is moved toward one of the ends of the housing towards the nose of the airplane in a direction opposite a force of the resilient means by movement of the weight using the extension and wherein in the flight during the launch when a force of inertia of the weight tending to hold the weight in a launch position is less than the force of the resilient means, the resilient means moves the weight towards the end of the housing towards the tail to change the flight pattern of the airplane after the launch and during the flight.

Still further, the present invention relates to a flight control apparatus for use in controlling a flight pattern of a toy airplane having a fuselage, a nose and a tail, which comprises: a support means having opposed ends which defines a path between the nose and tail of the airplane with a channel between the ends and having an opening along the path at one of the ends; a weight slidably mounted in the channel of the support means for movement along the path between the nose and the tail of the airplane with an extension through the opening of the support means; and a resilient means mounted on the weight and adjacent the weight which acts to move the weight to control the flight pattern of the airplane when the airplane reaches a point in the flight during the launch when a force of the resilient means tending to move the weight towards the tail of the airplane is greater than a force of inertia of the weight tending to prevent the weight from moving in the direction towards the tail in the path after the launch and during the flight.

Further still, the present invention relates to a flight control apparatus for use in controlling a flight pattern of a toy airplane having a nose and a tail during launch and flight, which comprises: a support means having opposed ends which defines a path between the nose and the tail of the airplane with an attachment means between the ends along the path and mounted on a fuselage of the airplane; a weight slidably mounted on the attachment means of the support means for movement along the path and with an extension provided on the weight which extends outward opposite the support means; and a resilient means mounted on the weight and adjacent the weight which acts to move the weight to control the flight pattern of the airplane when the airplane reaches a point in the flight during the launch when a force of the resilient means tending to move the weight in the path towards the tail in a direction opposite a direction of the flight of the airplane is greater than a force of inertia of the weight tending to prevent the weight from moving in the direction towards the tail in the path after the launch and during the flight.

Still further, the present invention relates to a method for controlling a flight pattern of a toy airplane during launch and flight, the airplane having a fuselage, a nose and a tail, which comprises: providing a flight control apparatus in the fuselage of the airplane, the flight control apparatus having a support means having opposed ends which defines a path between the nose and the tail of the airplane with a top side and a bottom side spaced therebetween and having an opening between the ends along the path; a weight slidably mounted on the top side of the support means for movement along the path and having an extension provided on the weight which extends through the opening of the support means; and a resilient means mounted on the weight and adjacent the weight and having a force such that when the airplane decreases in velocity, the resilient means moves the weight in the path towards the tail of the airplane in a direction opposite a direction of the flight of the airplane to control the flight pattern of the airplane in response to a decrease in inertia of the weight; providing a launching means for launching the airplane by moving the extension towards the nose of the airplane against the force of the resilient means; connecting the launching means to the extension of the weight so as to move the weight and the extension towards the nose of the airplane; and launching the airplane such that the airplane is in flight, wherein after the launch when the forward inertia of the weight caused by the flight of the airplane is less than the force of the resilient means, the resilient means moves the weight in the path away from the nose and towards the tail of the airplane to control the flight pattern of the airplane.

Further, the present invention relates to a toy airplane having a fuselage between a nose and tail of the airplane, the improvement which comprises: a flight control mechanism mounted on the fuselage of the airplane; a weight slidably mounted on the fuselage for movement along a path and having an extension; and a resilient means mounted on the weight and on the fuselage adjacent the weight wherein prior to launch of the airplane, the weight is moved in a first direction opposite a force of the resilient means towards the nose and wherein when a force of inertia of the weight is less than the force of the resilient means during flight, the resilient means moves the weight towards the tail in a second direction which changes a flight pattern of the airplane.

Further still, the present invention relates to a toy airplane having a fuselage with a nose and a tail for launch and flight of the airplane, the improvement which comprises: a flight control mechanism mounted on the fuselage for movement including: a weight contoured to move in a defined path between the nose and the tail; resilient means attached to the weight which biases the weight towards the tail; and an attachment means provided on the weight for urging the weight in the path towards the nose, wherein prior to the launch of the airplane, the attachment means and weight are moved in the path towards the nose against the bias of the resilient means, wherein during the flight, the attachment means and weight are moved towards the tail when a force of inertia of the weight and attachment means are less than the bias of the resilient means to change a flight pattern of the airplane during the flight.

Still further, the present invention relates to a flight control mechanism to be mounted on a toy airplane with a nose and a tail for launch and flight of the airplane, which comprises: a weight contoured to move in a defined path between the nose and tail; resilient means attached to the weight which biases the weight towards the tail; and an attachment means provided on the weight for urging the weight in the path towards the nose against the bias of the resilient means, wherein prior to the launch of the airplane the attachment means and the weight are moved in the path towards the nose against the bias of the resilient means and wherein during the flight, the attachment means and weight are moved towards the tail when a force of inertia of the weight and attachment means are less than the bias of the resilient means to change a flight pattern of the airplane during the flight.

Preferably the resilient means is a resilient member which extends completely through the weight and is connected at one end to the support means and at the other end to the weight. The resilient means preferably moves the weight in one direction when the inertial force on the weight is less than the force of the resilient means. Preferably, the housing and the weight have the same rectangular shape.

Figure 3:
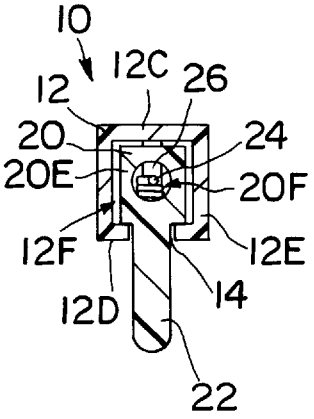
FIG. 3 is a cross-sectional view of the flight control apparatus 10 of FIG. 1 along the line 3—3 showing the extension 22 of the weight 20 extending through the opening 14 in the bottom wall 12D of the housing 12.
Figure 2:
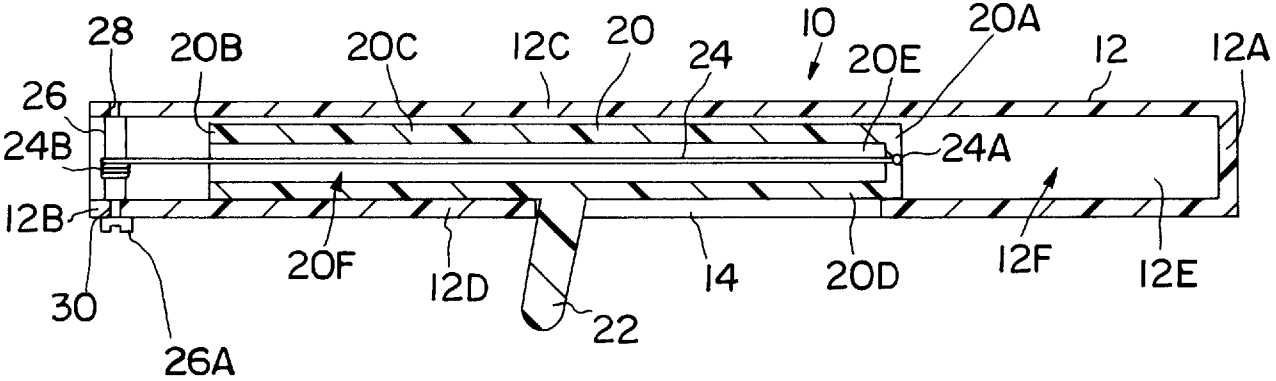
FIG. 2 is a cross-sectional view of the flight control apparatus 10 of FIG. 1 along the line 2—2 showing the weight 20 mounted in the channel 12F of the housing 12.
Figure 4:
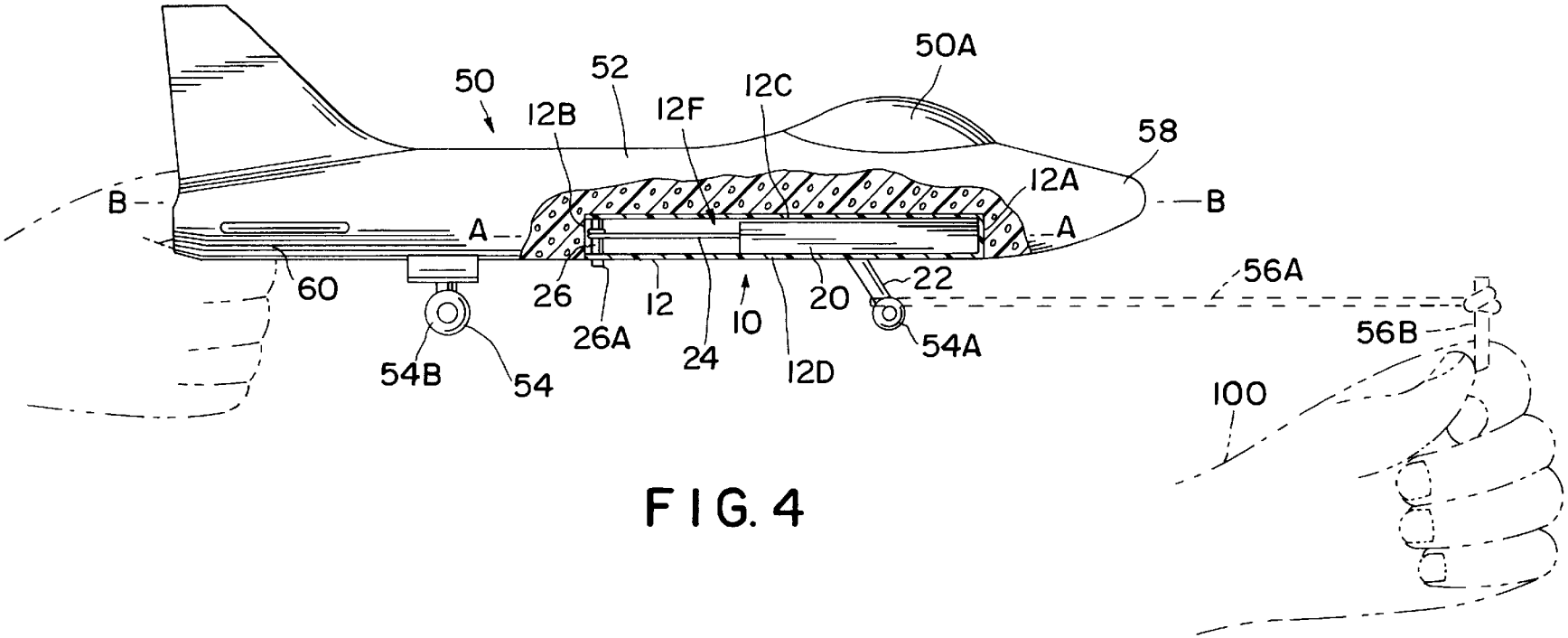
FIG. 4 is a left side view of the model airplane 50 with a cutout portion showing a cross-section of the housing 12 behind the left sidewall 20E showing the weight 20 in the forward most launch position.
Figure 5:
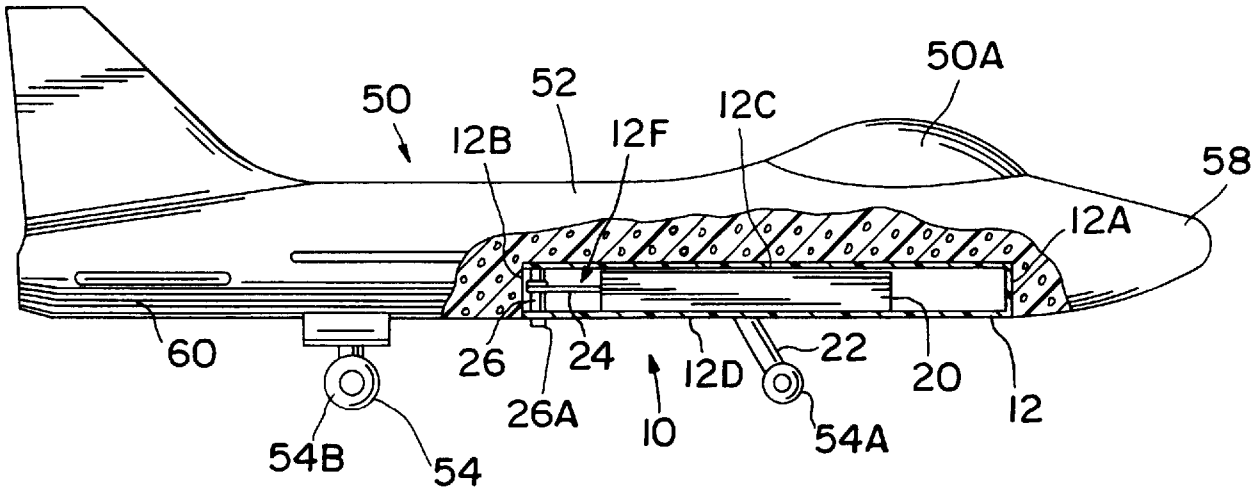
FIG. 5 is a left side view of the model airplane 50 with a cutout portion showing a cross-section of the housing 12 behind the left sidewall showing the weight 20 in the retracted position.

FIGS. 1 to 3 show the flight control apparatus 10 of the first embodiment of the present invention. FIGS. 4 and 5 show the apparatus 10 mounted in the fuselage 52 of an airplane 50 such that only the extension 22 of the weight 20 of the apparatus 10 extends beyond the fuselage 52 of the airplane 50. Preferably, the airplane 50 is similar to conventional model or toy glider airplanes well known in the art. The apparatus 10 may be mounted in the fuselage 52 of the airplane 50 by means of an adhesive (not shown) or any other attachment mechanism or alternately, the apparatus 10 may be integrally formed as part of the fuselage 52 of the airplane 50. The fuselage 52 of the airplane 50 is preferably of a size such as to completely encase the housing 12 of the apparatus 10. The airplane 50 may also be provided with landing gear 54 having a front and rear wheel 54A and 54B (FIG. 4). The airplane 50 is preferably constructed of polystyrene or balsa wood or some other lightweight material and is preferably manually launched using a slingshot-like launching device 56 which includes a resilient member 56A such as an elastic string or rubber band connected to a post 56B.

The apparatus 10 of the first embodiment includes a housing 12, a weight 20 and a resilient band 24. The housing 12 preferably has a front end 12A and a back end 12B with a top wall 12C, a bottom wall 12D and two sidewalls 12E spaced therebetween, all forming a channel 12F within the housing 12 (FIG. 1). The housing 12 preferably has a rectangular shape with an essentially square cross-section. The back end 12B is preferably open to allow insertion of the weight 20 (to be described in detail hereinafter). The bottom wall 12D of the housing 12 is provided with an opening 14 having a rectangular shape with rounded ends (FIG. 4). Preferably, the opening 14 is centered between the front and back ends 12A and 12B of the housing 12. The bottom wall 12D of the housing 12 adjacent the back end 12B preferably has a notch 16 which is aligned with the centerline of the opening 14. The notch 16 allows for easier insertion of the adjustment pin 26 and the weight 20 (to be described in detail hereinafter). A slot 18 extends between the notch 16 and the opening 14 and allows for insertion of the weight 20 into the channel 12F which allows the housing 12 to be manufactured as a single piece. The housing 12 is preferably constructed of a resilient material such that after the weight 20 is inserted into the notch 16 and slid along the slot 18 into position, the bottom wall 12D moves back to its original position thus, returning the slot 18 to its original width to hold the weight 20 tightly in place. Preferably, the housing 12 is constructed of any durable, lightweight material such as plastic.

Figure 6:
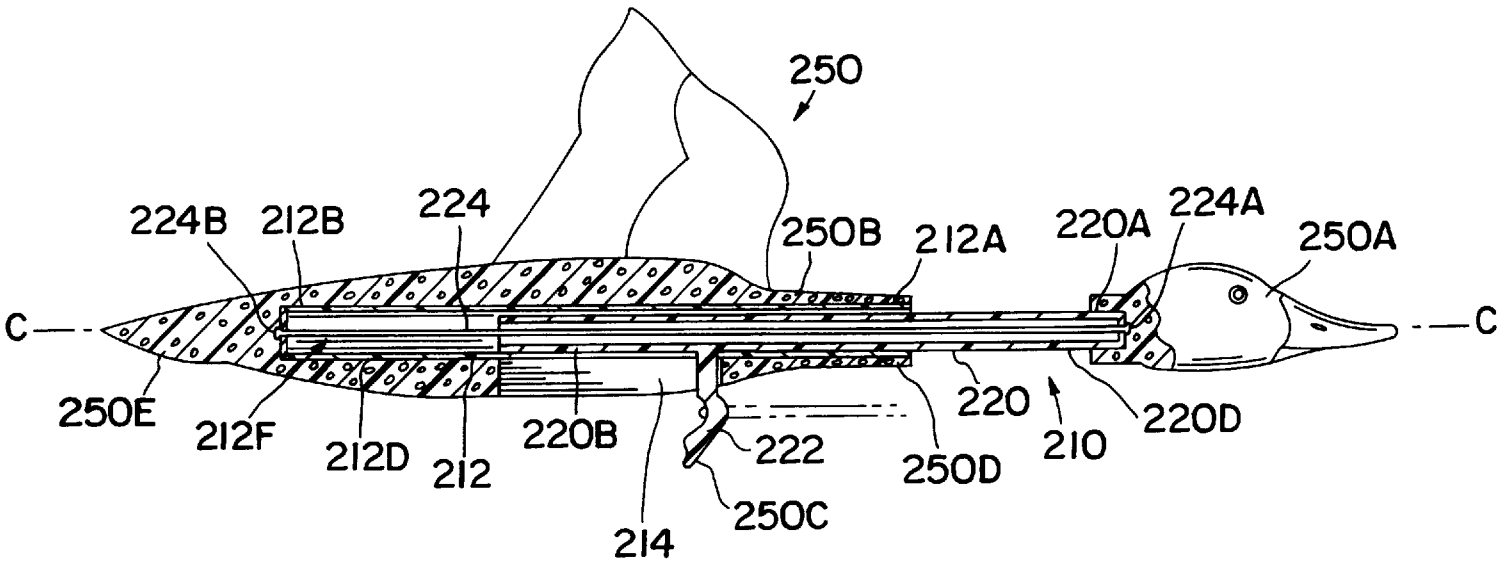
FIG. 6 is a cross-sectional left side view of a second embodiment showing the weight 220 attached to the head 250A of the duck-shaped airplane 250 in the forward most launch position.

The weight 20 is preferably rectangular in shape with an essentially square cross-section and is completely mounted in the channel 12F between the ends 12A and 12B of the housing 12 (FIG. 3). The weight 20 preferably has a front end 20A and a back end 20B with a top wall 20C, a bottom wall 20D and two sidewalls 20E spaced therebetween. In the first embodiment, the weight 20 has a cylindrical bore 2OF extending through the center of the weight 20 from the back end 20B to adjacent the front end 20A (FIG. 3). The back end 20B of the weight 20 is open to allow for mounting the resilient band 24 into the bore 20F of the weight 20. The diameter of the bore 20F is preferably slightly larger than the resilient band 24 to allow for easy mounting of the resilient band 24 (FIG. 3). The bottom wall 20D of the weight 20 is provided with an extension 22. The extension 22 is preferably equally spaced between the ends 20A and 20B of the weight 20 and extends outward from the bottom wall 20D away from the top wall 20C (FIG. 2). The extension 22 is preferably cylindrical in shape with a rounded end. Alternately, the end of the extension 22 opposite the bottom wall 20D is provided with a wheel which acts as the front wheel 54A of the landing gear 54 of the airplane 50 (FIGS. 5 and 6). The weight 20 is positioned within the channel 12F of the housing 12 such that the bottom wall 20D of the weight 20 is adjacent the bottom wall 12D of the housing 12 and the extension 22 of the weight 20 extends through the opening 14 in the bottom wall 12D of the housing 12. The height and width of the weight 20 are preferably slightly smaller than the height and width respectively of the housing 12 so as to allow the weight 20 to easily slide within the channel 12F of the housing 12 (FIG. 3). The width of the extension 22 is preferably slightly smaller than the width of the opening 14 in the bottom wall 12D of the housing 12 which allows the extension 22 to slide easily within the opening 14 (FIG. 1). The weight 20 is preferably shorter in length than the housing 12 such that when the weight 20 is in the forward most position, with the extension adjacent the front end of the opening 14, the front end 20A of the weight 20 is slightly spaced apart from the front end 12A of the housing 12 (FIG. 4). The length of the weight 20 and the position of the extension 22 on the bottom wall 20D of the weight 20 are preferably chosen such that in any position, the bottom wall 20D of the weight 20 completely covers the opening 14 in the bottom wall 12D of the housing 12 which prevents excess dirt and other foreign objects from entering the housing 12 (FIG. 2). The weight 20 is preferably constructed of a material such as plastic which provides the required weight for the given size.

The resilient band 24 is preferably a string having spaced apart first and second ends 24A and 24B. The resilient band 24 is mounted through the bore 20F of the weight 20 with the first end 24A of the band 24 connected to the front end 20A of the weight 20 and the second end 24B connected to an adjustment pin 26 (FIG. 2). The first end 24A of the band 24 can be mounted to the front end 20A of the weight 20 by any well known means. The second end 24B of the band 24 is preferably secured to the adjustment pin 26 such that as the pin 26 is rotated, the length and thus, the tension in the band 24 changes. The adjustment pin 26 preferably has a screw head 26A at one end and extends through the housing 12 adjacent the back end 12B such that the screw head 26A is adjacent the bottom wall 12D of the housing 12 on the side opposite the channel 12F. In the first embodiment, the end of the pin 26 opposite the head 26A is mounted in a hole 28 in the top wall 12C of the housing 12. The other end of the pin 26 adjacent the head 26A is mounted in a hole 30 which is spaced between the notch 16 and the slot 18 in the bottom wall 12D of the housing 12. The pin 26 is preferably tightly mounted in the housing 12 such that a user 100 is able to rotate the pin 26 to adjust the tension of the band 24 but the force of the band 24 is unable to rotate the pin 26. The resilient band 24 has a range of tension rating such that when the force of inertia on the weight 20 tending to move the weight 20 forward is at some point less than the maximum inertial, the resilient band 24 pulls the weight 20 back into the retracted position. The tension rating of the band 24 is preferably chosen based upon the weight of the weight 20 and the particular amount of inertial act on the weight 20 at the moment the user 100 wants the weight 20 to be moved into the retracted position. In the first embodiment, the resilient band 24 is preferably a fine rubber band and is constructed of elastic rubber.

In an alternate embodiment (not shown), the resilient band is a coil spring which is mounted in the channel of the housing between the front end of the housing and the front end of the weight. In this embodiment, the coil spring acts to push the weight into the retracted position when the force of inertia acting on the weight decreases below a certain point.

Figure 7:
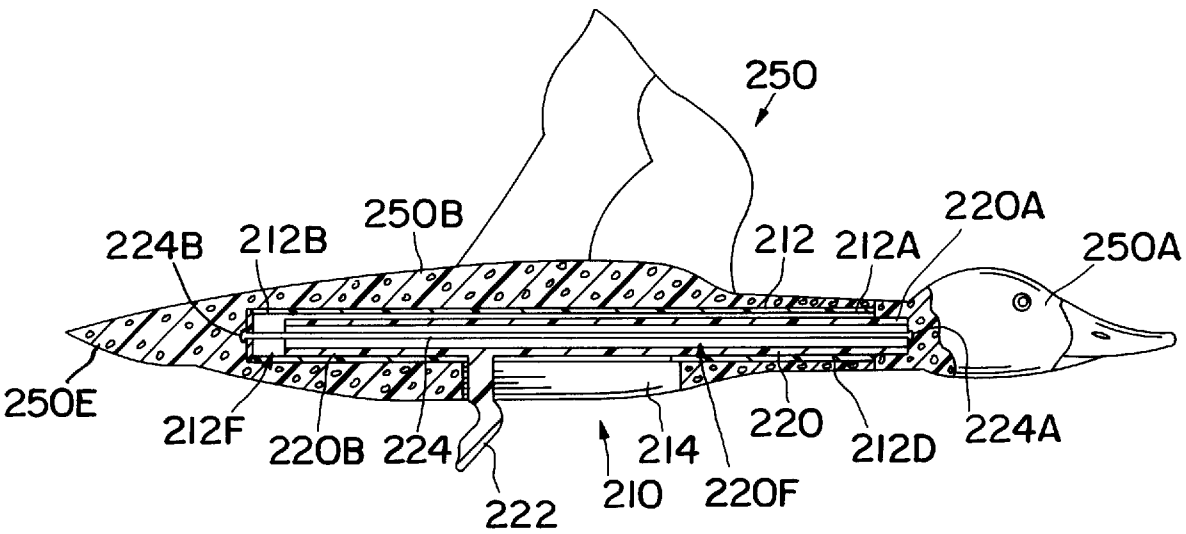
FIG. 7 is a cross-sectional left side view of the second embodiment showing the weight 220 attached to the head 250A of the duck-shaped airplane 250 in the retracted position.

FIGS. 6 and 7 show a second embodiment of the flight control apparatus 210 mounted in a duck-shaped model airplane 250. The second embodiment of the apparatus 210 is similar to the first embodiment except that the front end 212A of the housing 212 is open and the weight 220 is positioned in the channel 212F of the housing 212 such that in the fully retracted position, the front end 220A of the weight 220 extends beyond the front end 212A of the housing 212. The front end 220A of the weight 220 which extends beyond the housing 212 is attached to the back of the head 250A of the duck-shaped airplane 250. The head 250A of the duck-shaped airplane 250 is separate from the body 250B of the duck-shaped airplane 250 such that as the weight 220 slides forward and back, the head 250A slides toward and away from the body 250B. The slot (not shown) in the bottom wall 212D of the housing 212 preferably extends from the open front end 212A of the housing 212 to the opening 214 in the bottom wall 212D of the housing 212. The positioning of the slot allows the weight 220 to be inserted into the channel 212F in the housing 212 from the front end 212A. In the second embodiment, the extension 222 is preferably positioned slightly closer to the back end 220B of the weight 220. This uneven spacing allows the front end 220A of the weight 220 to be connected to the head 250A of the duck-shaped airplane 250. However, preferably the length of the bottom wall 220D of the weight 220 between the back end 220B and the extension 222 is such as to completely cover the opening 214 in the bottom wall 212D of the housing 212 (FIG. 6). In the second embodiment, the resilient band 224 is securely attached at both ends 224A and 224B. The first end 224A is attached to the front end 220A of the weight 220. The second end 224B of the band 224 is attached to the closed back end 212B of the housing 212. Alternately, the back end 212 may be a removable end cap (not shown) which allows for easier connection of the resilient band 224. It is also possible to include an adjustment means for the resilient band 224 similar to the adjustment pin 26 of the first embodiment. The end of the extension 222 opposite the weight 220 preferably has the shape of a duck foot 250C such as to resemble the foot of the duck-shaped airplane 250 (FIGS. 6 and 7).

Figure 8:
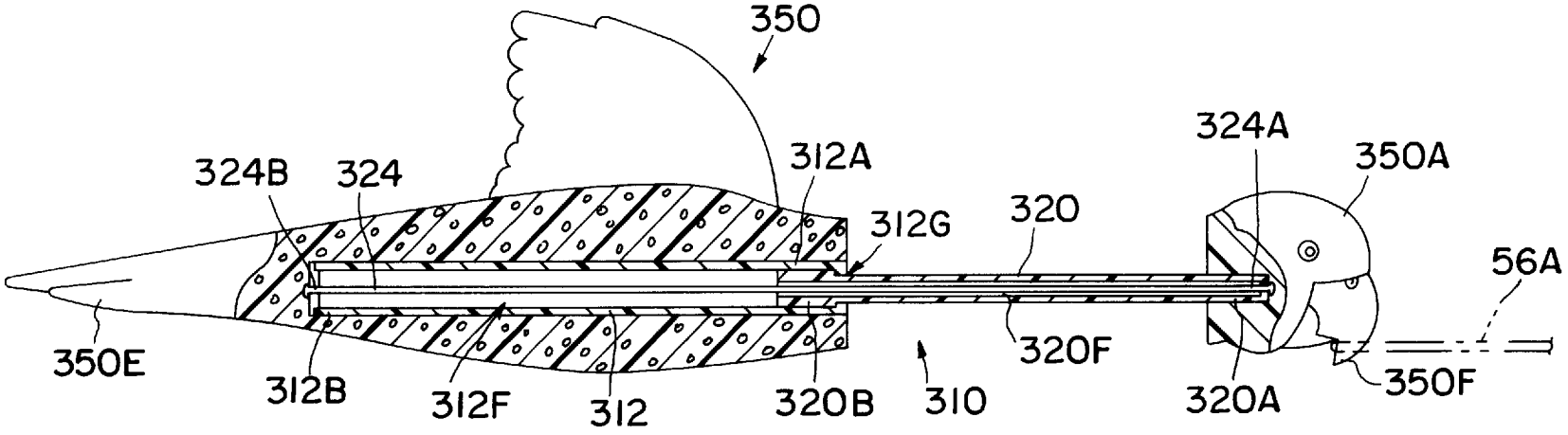
FIG. 8 is a cross-sectional left side view of the third embodiment showing the weight 320 attached to the head 350A of the bird-shaped airplane 350 in the forward most launch position.
Figure 9:
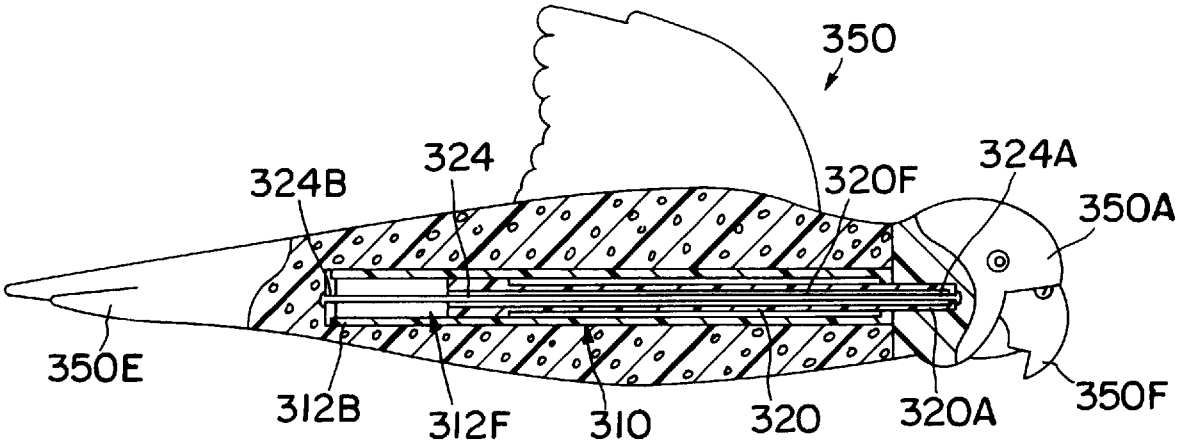
FIG. 9 is a cross-sectional left side view of the third embodiment showing the weight 320 attached to the head 350A of the bird-shaped airplane 350 in the retracted position.

In a third embodiment as shown in FIGS. 8 and 9, the flight control apparatus 310 is mounted in the body 352 of the bird-shaped airplane 350 similarly to the mounting of the flight control apparatus 210 of the second embodiment with the front end 320A of the weight 320 attached to the head 350A of the duck-shaped airplane 350. The back end 320B of the weight 320 is preferably larger than the remainder of the weight 320 such that the weight 320 does not extend completely through the opening 312G in the front end 312A of the housing 312. Preferably, the opening 312G at the front end 312A of the housing 312 is slightly smaller than the channel 312F of the housing 312. The weight 320 does not have an extension. To move the weight 320 forward against the resilient band 324, the user pulls on the head 350A of the bird-shaped airplane 350 while holding the tail 350E of the airplane 350 stationary. Preferably, the head 350A of the bird-shaped airplane 350 is provided with a hook 350F in the shape of a beak to allow for attachment of the resilient member 56A of the launching device 56.

Figure 10:
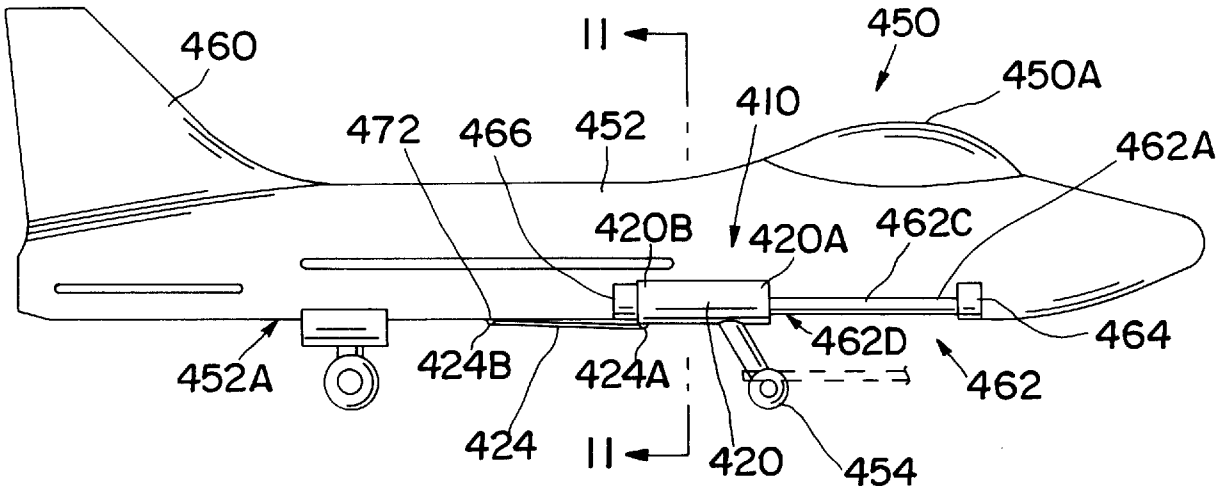
FIG. 10 is a left side view of the airplane 450 of the fourth embodiment showing the weight 420 mounted on the bottom section 452A of the fuselage 452.
Figure 11:
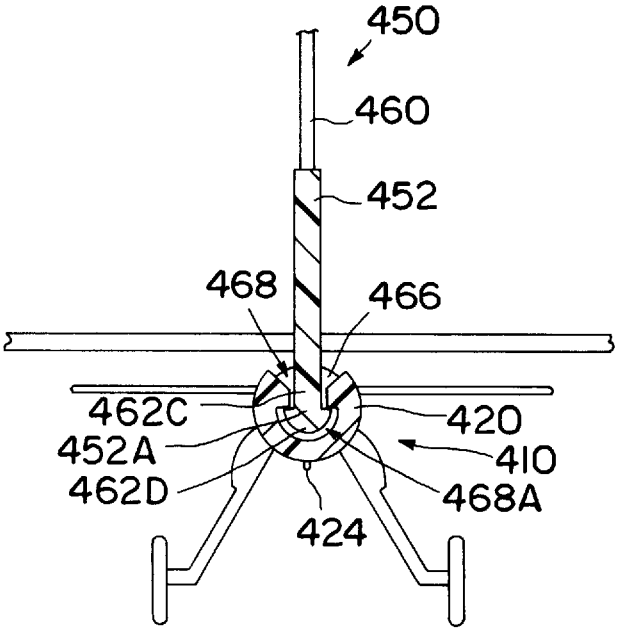
FIG. 11 a cross-sectional view of the airplane of FIG. 10 along the line 11—11 showing the weight 420 mounted on the bottom section 452A of the fuselage 452.

FIGS. 10 to 11 show the apparatus 410 of the fourth embodiment. In the fourth embodiment, the apparatus 410 includes a weight 420 and a resilient band 424. The airplane 450 of the fourth embodiment is preferably similar to those well known in the art and has a fuselage 452 having a minimal thickness. Preferably, the fuselage 452 of the airplane 450 of the fourth embodiment has a thickness of approximately 0.12 inches (3.00 mm). A notch 462 is provided along the bottom edge 452A of the fuselage 452 essentially beneath the cockpit 450A of the airplane 450. The position of the notch 462 depends upon the distribution of the weight of the airplane 450 along the fuselage 452 and the size and weight of the weight 420 of the apparatus 410. The notch 462 preferably has a front end 462A and a back end (not shown) with a center section 462C spaced therebetween. The center section 462C of the notch 462 is preferably provided with a semi-circular attachment tongue 462D which extends between the ends 462A of the notch 462. The attachment tongue 462D is preferably formed as part of the fuselage 450A of the airplane 450. In the preferred embodiment, the tongue 462D extends outward beyond the fuselage 452 an even distance of 0.08 inches (2.00 mm) on each side of the fuselage 452. The front and back ends 462A of the notch 462 are preferably provided with front and back end stoppers 464 and 466, respectively. The end stoppers 464 and 466 are preferably flush with the bottom edge 452A of the fuselage 456 and have a width slightly wider than the width of the attachment tongue 462D. Preferably, the end stoppers 464 and 466 are circular in shape and extend the entire depth of the notch 462.

The weight 420 preferably has a cylindrical shape with a front end 420A and a back end 420B. The top of the weight 420 is provided with a groove 468 which extends into a bore 468A. The groove 468 preferably has beveled walls which angle outward such that the top of the groove 468 opposite the bore 468A is wider than the bottom of the groove 468 adjacent the bore 468A (FIG. 11). The bore 468A has a semi-circular shape similar to the shape of the attachment tongue 462D. The groove 468 and the bore 468A extend longitudinally completely through the weight 420. In the fourth embodiment, the weight 420 is preferably constructed of a resilient plastic. The weight 420 is provided with an extension 424 which extends downward opposite the groove 468 (FIG. 8). The extension 424 can be provided with a wheel which acts as the landing gear 454 similar to the first embodiment. The back end 420B of the weight 420 is provided with an aperture (not shown) which allows for connection of the resilient band 424. The resilient band 424 is preferably similar to the resilient band 24 of the first embodiment and has a first end 424A and a second end 424B. The first end 424A of the band 424 is connected through an aperture (not shown) to the back end 420B of the weight 420. The second end 424B of the band 424 is connected to the fuselage 452 through an aperture (not shown) adjacent the tail 460 of the airplane 450 (FIG. 8). The resilient band 424 may be attached to the weight 420 by any well known means. As with the other embodiments, the apparatus 410 of the fourth embodiment may also be provided with an adjustment device (not shown).

IN USE

In the first embodiment, the apparatus 10 is assembled prior to insertion into the fuselage 52 of the airplane 50. To assemble the apparatus 10, the resilient band 24 is inserted into the bore 20F of the weight 20 and the first end 24A is secured to the front end 20A of the weight 20 on the inside of the weight 20. The second end 24B of the band 24 is connected to the adjustment pin 26. Next, the weight 20 is inserted into the channel 12F of the housing 12. The weight 20 is inserted by first inserting the front end 20A of the weight 20 into the open back end 12B of the housing 12 such that the bottom wall 20D of the weight 20 is adjacent the bottom wall 12D of the housing 12. The weight 20 is easily inserted into the channel 12F until the extension 22 is in the notch 16 in the bottom wall 12D of the housing 12. The user 100 continues to pull or push the weight 20 into the channel 12F which causes the slot 18 adjacent the notch 16 to widen to allow the extension 22 into the slot 18. The weight 20 is inserted into the channel 12F until the extension 22 is in the opening 14 in the bottom wall 12D of the housing 12. Once the extension 22 is through the slot 18, the slot 18 preferably returns to its original width thus, trapping the extension 22 in the opening 14. Preferably, the slot 18 is of such a width that the extension 22 cannot be easily inserted into the slot 18 without considerable force. Once the weight 20 is in place, the adjustment pin 26 is then mounted in the back end 12B of the housing 12. The adjustment pin 26 is mounted by first inserting the end opposite the head 26B into the hole 28 in the top wall 12C of the housing 12 and then inserting the other end of the pin 26 adjacent the head 26B into the notch 16 in the bottom wall 12D of the housing 12 and pushing on the pin 26 until the pin 26 is in position in the hole 30 in the bottom of the housing 12. The adjustment pin 26 is then rotated as necessary to bring the resilient band 24 to the correct tension. The tension of the resilient band 24 must be at least great enough to pull the weight 20 into the retracted position. Preferably the tension of the band 24 has a rating such that the resilient band 24 is able to move the weight 20 into the retracted position when there is still inertia acting on the weight 20 tending to move or hold the weight 20 in the forward position.

Once fully assembled, the apparatus 10 is then mounted in the fuselage 52 of the airplane 50. The apparatus 10 is mounted such that the front end 12A of the housing 12 is adjacent the nose 58 of the airplane 50 and the back end 12B of the housing 12 is adjacent the tail 60 of the airplane 50. The apparatus 10 is preferably of a length such that the front end 12A of the housing 12 extends almost completely beneath the cockpit 50A of the airplane 50 and the back end 12B of the housing 12 is positioned approximately in the middle of the airplane 50. In the first embodiment, the airplane 50 preferably has a length of 6.69 inches (170 mm). The housing 12 of the apparatus 10 preferably has a length of 2.95 inches (75.0 mm) and is positioned 1.0 inches (25.0 mm) from the nose 58 of the airplane 50. The apparatus 10 is preferably mounted such that the axis A—A of the apparatus 10 is aligned with the axis B—B of the airplane 50 (FIG. 4). Preferably, the apparatus 10 is positioned along the bottom portion of the fuselage 52 of the airplane 50. The exact length and positioning of the apparatus 10 will necessarily depend upon the design of the airplane 50 and the size of the apparatus 10. The particular weight 20 is chosen for the apparatus 10 dependent upon the size and weight of the airplane 50. In the first embodiment, with the airplane 50 having a length of 6.69 inches (170 mm) and a wingspan of 7.87 inches (200 mm) and a weight of 0.13 oz. (3.70 g), the weight 20 is preferably between 0.03 and 0.05 oz. (0.75 and 1.50 g). The resilient band 24 is selected based on the size and weight of the weight 20. In addition, the tension of the resilient band 24 can be adjusted by using the adjustment pin 26 before or after the apparatus 10 has been mounted in the airplane 50.

In the second embodiment, the apparatus 210 is assembled similarly to the apparatus 10 of the first embodiment except that the weight 220 is inserted through the front end 212A of the housing 212. The apparatus 210 is mounted in the center of the duck-shaped airplane 250 such that the apparatus 210 and the duck-shaped airplane 250 have the same axis C—C (FIG. 7). The apparatus 210 is mounted such that the front end 212A of the housing 212 is in the neck 250D of the duck-shaped airplane 250 with the front end 220A of the weight 220 extending into the head 250A of the duck-shaped airplane 250. The back end 212B of the housing 212 of the apparatus 210 extends almost completely to the tail 250E of the duck-shaped airplane 250.

The apparatus of the third embodiment is easily assembled due to the absence of the extension. To assemble, the weight 320 is inserted into the channel 312F of the housing 312 with the first end 324A of the resilient band 324 attached to the weight 320 and extending through the bore 320F. The second end 324B of the resilient band 324 is attached to the back end 312B of the housing 312. The apparatus 310 is mounted in the body 352 of the bird-shaped airplane 350 similar to the mounting of the second embodiment.

In the fourth embodiment, assembly of the apparatus 410 is performed simultaneously with mounting of the apparatus 410 on the airplane 450. The weight 420 is mounted directly on the fuselage 452 of the airplane 450. To mount the weight 420, the weight 420 is snapped over the attachment tongue 462D of the fuselage 452 until the attachment tongue 462D is completely within the bore 468A of the groove 468 and the weight 420 is spaced between the end stoppers 464 and 466 of the groove 468. The groove 468 is preferably formed such as to increase ease of inserting the attachment tongue 462D in the bore 468D by guiding the attachment tongue 462D into the bore 468D in the bore 468A. The resilient nature of the weight 420 preferably enables the groove 468 to return to its normal width once the attachment tongue 462D is within the bore 468A. Thus, the attachment tongue 462D fit together in a "tongue and groove" relationship. The weight 420 will only slide in the notch 462 if the attachment tongue 462D of the notch 462 is matched with the bore 468A of the weight 420. The front and back stoppers 464 and 466 act to keep the weight 420 within the notch 462. Finally, the resilient band 424 is connected between the back end 420B of the weight 420 and the fuselage 452 of the airplane 450.

In the first embodiment, to launch the airplane 50, the resilient member 56A of the launching device 56 is attached around the extension 22 of the weight 20. The user 100 then holds the tail 60 of the airplane 50 in one hand and pulls forward on the post 56B of the launching device 56 with the other hand (FIG. 4). By pulling forward, the user 100 moves the weight 20 by the extension 22 to the forward most position. The user 100 then aims the nose 58 of the airplane 50 and releases the tail 60 of the airplane 50. Preferably, the user 100 aims the nose 58 of the airplane 50 either upward, away from the ground surface (not shown) or horizontally, parallel to the ground surface.

During the initial period of flight of the airplane 50, the weight 20 stays forward due to the force of inertia of the weight 20 as opposed to the force of wind drag on the airplane 50. The wind drag on the airplane 50 keeps the weight 20 in the forward position. As the airplane 50 starts to decelerate, the force of inertia of the weight 20 decreases. Once the force of inertia of the weight 20 which acts to hold the weight 20 in the forward position, is less than the force of the resilient band 24 acting on the weight 20 and tending to move the weight 20 backwards into the retracted position, the weight 20 moves in a direction opposite to the direction of flight. As the inertia force of the weight 20 continues to decrease, the weight 20 moves back into the retracted position (FIG. 5). Preferably, the decrease in the inertia force occurs quickly such that the weight 20 is pulled back instantaneously. However, preferably the drag on the airplane 50, without the additional force of the resilient band 24, does not move the weight 20 into the retracted position. Preferably, there is minimal air drag on the apparatus 10 itself due to the fact that the apparatus 10 is completely within the fuselage 52 of the airplane 50 except for the extension 22 of the weight 20. In addition, if the airplane 50 is launched upward, the force of gravity acting on the weight 20 works with the force of the resilient band 24 to move the weight 20 backwards faster. The point at which the weight 20 shifts can be adjusted by adjusting the tension of the resilient band 24 such as by means of the adjustment pin 26.

The shifting of the weight 20 in the apparatus 10 causes the center of magnitude of the airplane 50 to shift backwards which causes the flight pattern of the airplane 50 to change. In the first embodiment, where the weight 20 weighs 0.04 oz. (1.10 g) and is 2.0 inches (50.8 mm) in length and the airplane 50 weighs 0.13 oz. (3.70 g) and has a length of 6.7 inches (170.2 mm), when the weight 20 shifts 0.55 inches (14.0 mm), the center of magnitude of the airplane 50 shifts 0.16 inches (4.0 mm). In the first embodiment, if the airplane 50 is launched horizontally, parallel to the ground surface, the shifting weight 20 causes the airplane 50 to either continue to fly horizontally or to rise slightly due to the nose 58 of the airplane 50 lifting slightly. Preferably, if the airplane 50 is launched upward about 100 ft. (30,180 mm) which depends on the launching device 56, the shifting of the weight 20 causes the nose 58 of the airplane 50 to tip downward such that the airplane 50 levels off toward horizontal and slowly glides downward for approximately 200 ft. (60,960 mm) to the ground surface. Preferably, the flight control apparatus 10 acts to increase the overall duration of flight of the airplane 50.

In the second embodiment, the duck-shaped airplane 250 is launched similarly to the airplane 50 of the first embodiment. In the prelaunch position, the weight 220 is fully forward which extends the head 250A of the duck-shaped airplane 250 forward which increases the length of the neck 250D of the duck-shaped airplane 250 (FIG. 6). When the inertia acting on the weight 220 begins to decrease such as to be less than the force of the resilient band 224 tending to move the weight 220 backward, the weight 220 moves backward. As the weight 220 moves backward, the head 250A of the duck-shaped airplane 250 moves toward the body 250B of the duck-shaped airplane 250 as the neck 250D becomes shorter (FIG. 7). As in the first embodiment, if the duck-shaped airplane 250 is launched upward, the force of gravity acting on the weight 220 can assist the resilient band 224 to move the weight 220 back faster. In addition, due to the head 250A attached to the front end 220A of the weight 220, the force of air or friction force (air drag) acting on the head 250A and thus, the front end 220A of the weight 220, could also change the timing of the shift of the weight 220 and the force of the resilient band 224 necessary to move the weight 220.

In the third embodiment, to launch the bird-shaped airplane 350, the user 100 grasps the tail 350E of the bird-shaped airplane 350 and attaches the resilient member 56A of the launching device 56 onto the beak 350F of the bird-shaped airplane 350 and pulls. The airplane 350 is then launched similarly and acts similarly to the duck-shaped airplane 250 of the second embodiment.

In the fourth embodiment, the airplane 450 is launched similar to the airplane 50 of the first embodiment. First, the user places the resilient member 56A of the launching device 56 onto the extension 424 of the weight 420. The user then grasps the tail 460 of the airplane 450 and pulls backward on the tail 460 or forward on the launching device 56. The airplane 450 is then launched similarly and acts similarly to the airplane 50 of the first embodiment.

This invention was described in Disclosure Document No. 362600, filed Oct. 3, 1994.

It is intended that the foregoing description be only illustrative of the present invention and that the present invention be limited only by the hereinafter appended claims.

I claim:

1. A flight control apparatus for use in controlling a flight pattern of a toy airplane having a nose, wings and a tail during launch and flight, which comprises:

(a) a support means having opposed ends which DAM defines a path between the nose and the tail of the airplane with an opening between the ends along the path;

(b) a weight slidably mounted on the support means for movement along the path and with an extension provided on the weight which extends through the opening of the support means; and (c) a resilient means mounted on the weight and adjacent the weight which acts to move the weight without moving the wings of the airplane to control the flight pattern of the airplane when the airplane reaches a point in the flight during the launch when a force of the resilient means tending to move the weight in the path towards the tail in a direction opposite a direction of the flight of the airplane is greater than a force of inertia of the weight tending to prevent the weight from moving in the direction towards the tail in the path after the launch and during the flight.

2. The apparatus of claim 1 wherein the resilient means has opposed ends and is connected at one end to the support means and at the other end to the weight.

3. The apparatus of claim 2 wherein the resilient means is a resilient member.

4. The apparatus of claim 2 wherein the resilient means moves the weight inside the support means in the direction in the path towards the tail when the inertial force of the weight is less than the force of the resilient means.

5. The apparatus of claim 1 wherein a tension of the resilient means is adjustable to adjust the force of the resilient means tending to move the weight to change the flight pattern.

6. The apparatus of claim 1 wherein the extension of the weight is provided with a wheel to assist in landing of the airplane.

7. The apparatus of claim 1 wherein the opening in the support means is of such a length as to limit the movement of the weight so that horizontal gliding of the airplane can be produced when the extension moves towards the tail of the airplane.

8. The apparatus of claim 1 wherein the weight is of such a length as to cover the opening in the support means at any position.

9. A flight control apparatus for use in controlling a flight pattern of a toy airplane having a nose, wings and a tail during launch and flight, which comprises:

(a) a housing having opposed ends with a top wall, a bottom wall and a sidewall extending therebetween and forming a channel defining a path between the ends, the bottom wall having an opening along the path between the ends which extends into the channel;

(b) a weight slidably mounted in the channel of the housing adjacent the bottom wall provided with an extension for moving the weight in the path which extends through the opening in the bottom wall of the housing; and (c) a resilient means mounted in the channel of the housing between the housing and the weight providing a bias towards the tail of the airplane, wherein prior to and during launch of the airplane, the weight is moved toward one of the ends of the housing towards the nose of the airplane in a direction opposite a force of the resilient means by movement of the weight using the extension and wherein in the flight during the launch when a force of inertia of the weight tending to hold the weight in a launch position is less than the force of the resilient means, the resilient means moves the weight without moving the wings of the airplane towards the end of the housing towards the tail to change the flight pattern of the airplane after the launch and during the flight.

10. The apparatus of claim 9 wherein the resilient means has opposed ends and is connected at one end to one of the ends of the housing towards the tail and at the other end to the weight.

11. The apparatus of claim 9 wherein the resilient means is a resilient member.

12. The apparatus of claim 9 wherein the resilient means moves the weight toward the end of the housing when the inertial force of the weight is less than the force of the resilient means to that horizontal gliding of the airplane can be produced when the extension moves towards the tail.

13. The apparatus of claim 9 wherein a tension of the resilient means is adjustable to adjust the force of the resilient means tending to move the weight to change the flight pattern.

14. The apparatus of claim 9 wherein the opening in the bottom wall of the housing is of such a length as to limit the movement of the weight so that horizontal gliding of the airplane can be produced when the weight and extension moves towards the tail.

15. The apparatus of claim 9 wherein the airplane has a shape of a bird and wherein an end of the weight opposite the resilient means is connected to a head of the bird so that as the weight moves, the head is extended during launch and is retracted when the weight moves towards the tail.

16. A flight control apparatus for use in controlling a flight pattern of a toy airplane having a fuselage, a nose, wings and a tail, which comprises:

(a) a support means having opposed ends which defines a path between the nose and tail of the airplane with a channel between the ends and having an opening along the path at one of the ends;

(b) a weight slidably mounted in the channel of the support means for movement along the path between the nose and the tail of the airplane with an extension through the opening of the support means; and (c) a resilient means mounted on the weight and adjacent the weight which acts to move the weight without moving the wings of the airplane to control the flight pattern of the airplane when the airplane reaches a point in the flight during the launch when a force of the resilient means tending to move the weight towards the tail of the airplane is greater than a force of inertia of the weight tending to prevent the weight from moving towards the tail in the path after the launch and during the flight.

17. The apparatus of claim 16 wherein the opening of the channel is at one of the ends of the support means towards the nose of the airplane.

18. The apparatus of claim 17 wherein the weight has opposed ends each with a weight and one of the ends extends through the opening of the channel of the support means.

19. The apparatus of claim 18 wherein the nose of the airplane is detached from the fuselage of the airplane such that the nose is able to move toward and away from the fuselage of the airplane along with the weight and wherein the end of the weight extending through the opening of the channel is connected to the nose of the airplane.

20. A flight control apparatus for use in controlling a flight pattern of a toy airplane having a nose, wings and a tail during launch and flight, which comprises:

(a) a support means having opposed ends which defines a path between the nose and the tail of the airplane with an attachment means between the ends along the path and mounted on a fuselage of the airplane;

(b) a weight slidably mounted on the attachment means of the support means for movement along the path and with an extension provided on the weight which extends outward opposite the support means; and (c) a resilient means mounted on the weight and adjacent the weight which acts to move the weight without moving the wings of the airplane to control the flight pattern of the airplane when the airplane reaches a point in the flight during the launch when a force of the resilient means tending to move the weight in the path towards the tail in a direction opposite a direction of the flight of the airplane is greater than a force of inertia of the weight tending to prevent the weight from moving in the direction towards the tail in the path after the launch and during the flight.

21. The apparatus of claim 20 wherein the resilient means has opposed ends and is connected at one end to the fuselage of the airplane and at the other end to the weight and wherein the resilient means moves the weight in one direction when the inertial force of the weight is less than the force of the resilient means.

22. The apparatus of claim 21 wherein the resilient means is a resilient member.

23. The apparatus of claim 20 wherein a tension of the resilient means is adjustable to adjust the force of the resilient means tending to move the weight to change the flight pattern.

24. A method for controlling a flight pattern of a toy airplane during launch and flight, the airplane having a fuselage, a nose, wings and a tail, which comprises:

(a) providing a flight control apparatus in the fuselage of the airplane, the flight control apparatus having a support means having opposed ends which defines a path between the nose and the tail of the airplane with a top side and a bottom side spaced therebetween and having an opening between the ends along the path; a weight slidably mounted on the top side of the support means for movement along the path and having an extension provided on the weight which extends through the opening of the support means; and a resilient means mounted on the weight and adjacent the weight and having a force such that when the airplane decreases in velocity, the resilient means moves the weight without moving the wings of the airplane in the path towards the tail of the airplane in a direction opposite a direction of the flight of the airplane to control the flight pattern of the airplane in response to a decrease in inertia of the weight;

(b) providing a launching means for launching the airplane by moving the extension towards the nose of the airplane against the force of the resilient means;

(c) connecting the launching means to the extension of the weight so as to move the weight and the extension towards the nose of the airplane; and (d) launching the airplane such that the airplane is in flight, wherein after the launch when the forward inertia of the weight caused by the flight of the airplane is less than the force of the resilient means, the resilient means moves the weight in a path away from the nose and towards the tail of the airplane to control the flight pattern of the airplane.

25. The method of claim 24 wherein the fuselage of the airplane is held during the launching such that when launched the airplane moves upward.

26. The method of claim 24 wherein the fuselage of the airplane is held during the launching such that when launched the airplane moves in a horizontal direction parallel with a ground surface.

27. The method of claim 25 wherein the weight has a weight such as to cause the airplane to level off toward the horizontal and glide toward the ground surface when the weight moves towards the tail in response to the resilient means.

28. The method of claim 26 wherein the weight has a weight such as to cause the airplane to curve upward or continue along a horizontal plane when the weight moves in response to the resilient means.

29. In a toy airplane having a fuselage between a nose, wings and tail of the airplane, the improvement which comprises:

a flight control mechanism mounted on the fuselage of the airplane; a weight slidably mounted on the fuselage for movement along a path and having an extension; and a resilient means mounted on the weight and on the fuselage adjacent the weight wherein prior to launch of the airplane, the weight is moved in a first direction opposite a force of the resilient means towards the nose and wherein when a force of inertia of the weight is less than the force of the resilient means during flight, the resilient means moves the weight without moving the wings of the airplane towards the tail in a second direction which changes a flight pattern of the airplane.

30. In a toy airplane having a fuselage with a noses wings and a tail for launch and flight of the airplane, the improvement which comprises:

(a) a flight control mechanism mounted on the fuselage for movement including:

(i) a weight contoured to move in a defined path between the nose and the tail;

(ii) resilient means attached to the weight which biases the weight towards the tail; and (iii) an attachment means provided on the weight for urging the weight in the path towards the nose wherein prior to the launch of the airplane, the attachment means and weight are moved in the path towards the nose against the bias of the resilient means, wherein during the flight, the attachment means and weight are moved towards the tail when a force of inertia of the weight and attachment means are less than the bias of the resilient means to change a flight pattern of the airplane without moving the wings of the airplane during the flight.

31. A flight control mechanism to be mounted on a toy airplane with a nose, wings and a tail for launch and flight of the airplane, which comprises:

(a) a weight contoured to move in a defined path between the nose and tail;

(b) resilient means attached to the weight which biases the weight towards the tail; and (c) an attachment means provided on the weight for urging the weight in the path towards the nose against the bias of the resilient means, wherein prior to the launch of the airplane the attachment means and the weight are moved in the path towards the nose against the bias of the resilient means and wherein during the flight, the attachment means and weight are moved towards the tail when a force of inertia of the weight and attachment means are less than the bias of the resilient means to change a flight pattern of the airplane without moving the wings of the airplane during the flight.

32. A flight control apparatus for use in controlling a flight pattern of a toy airplane having a nose and a tail during launch and flight, which comprises:

(a) a support means having opposed ends which defines a path between the nose and the tail of the airplane with an opening between the ends along the path;

(b) a weight slidably mounted on the support means for movement along the path and with an extension provided on the weight which extends through the opening of the support means wherein the extension of the weight is provided with a wheel to assist in landing of the airplane; and (c) a resilient means mounted on the weight and adjacent the weight which acts to move the weight to control the flight pattern of the airplane when the airplane reaches a point in the flight during the launch when a force of the resilient means tending to move the weight in the path towards the tail in a direction opposite a direction of the flight of the airplane is greater than a force of inertia of the weight tending to prevent the weight from moving in the direction towards the tail in the path after the launch and during the flight.

33. A flight control apparatus for use in controlling a flight pattern of a toy airplane having a nose and a tail during launch and flight, which comprises:

(a) a support means having opposed ends which defines a path between the nose and the tail of the airplane with an opening between the ends along the path;

(b) a weight slidably mounted on the support means for movement along the path and with an extension provided on the weight which extends through the opening of the support means wherein the weight is of such a length as to cover the opening in the support means at any position; and (c) a resilient means mounted on the weight and adjacent the weight which acts to move the weight to control the flight pattern of the airplane when the airplane reaches a point in the flight during the launch when a force of the resilient means tending to move the weight in the path towards the tail in a direction opposite a direction of the flight of the airplane is greater than a force of inertia of the weight tending to prevent the weight from moving in the direction towards the tail in the path after the launch and during the flight.

* * * * *